US005746351A

United States Patent [19]

Brotz

[11] Patent Number: 5,746,351

[45] Date of Patent: May 5, 1998

[54] PALLETTE DISPENSER

[76] Inventor: Gregory R. Brotz, P.O. Box 1322, Sheboygan, Wis. 53081

[21] Appl. No.: 705,542

[22] Filed: Aug. 29, 1996

[51] Int. Cl.[6] ..... B65D 35/22

[52] U.S. Cl. ..... 222/106; 222/94; 222/192

[58] Field of Search ..... 222/94, 105, 106, 222/192

[56] References Cited

U.S. PATENT DOCUMENTS 2,166,307 7/1939 Libby ..... 222/94

5,638,990 6/1997 Kastberg ..... 222/106

*Primary Examiner*—Joseph Kaufman

*Attorney, Agent, or Firm*—William Nitkin

[57] ABSTRACT

A palette dispenser having an aperture in the center thereof in which aperture is attached the nozzle of a container of paste-like or viscous material which material is squeezed out of the container through the nozzle and onto a palette base. In its storage mode a cover member is positioned over the aperture with downward pressure to flatten the material and spread it toward or beyond the outer edge of the cover member to form a layer of such material under or around the cover member for preventing the drying of the remaining material under the cover member near the aperture in the palette base. Supports are provided to dispose the palette base at various angles. Further embodiments of the dispenser can accommodate a plurality of containers of material and provide an enlarged mixing area of the palette base.

11 Claims, 4 Drawing Sheets

PALLETTE DISPENSER

BACKGROUND OF THE INVENTION

1. Field of the Invention

This application relates to dispensers of paste-like or viscous material contained within a container and more particularly relates to a dispenser having support means for the container, a surface area serving as a palette on which the material can be spread and a cover member to be placed thereover during storage to maintain the freshness of the material beneath the cover member and within the container.

2. Description of the Prior Art

In my prior U.S. Pat. No. 4,974,757 for a Dispenser I disclosed a dispensing system having a cap which allowed for the drying of hardenable material from a container around the edge of the cap to prevent the drying of such material within the opening of the container. Such dispensing system, though, lacked sufficient surface area on which to perform any functions with the material and lacked a support structure for the container.

SUMMARY OF THE INVENTION

It is an object of this invention to provide a dispenser for the dispensing of paste-like or viscous material from a container, such dispenser having a palette base having an aperture therein for receipt of the nozzle of the container, such palette base having a surface of sufficient area to form a mixing area thereon and a cover member having a bottom planar surface of smaller area, wherein placement of the cover member over the aperture produces an air-tight seal over the material or otherwise spreads the material out into a thin layer between the palette base and the bottom surface of the cover member. The cover member substantially prevents air from coming in contact with the material so that drying or air-curing occurs very slowly, starting from the exterior edge of the thin layer of material to the opening of the container.

It is a further object of this invention to provide a palette base on which various functions can be performed with the material, such as the mixing of various components together in the mixing area.

It is a still further object of this invention to provide a support structure for supporting one or more containers.

The advantage of edge-drying of material, as stated in my aforementioned patent, is that the material does not dry in the opening of the container, such as a tube or cartridge, but instead the material only dries along the very outer edge of the cover member when it is positioned thereon away from the opening, which dried material can be disposed of when the dispenser of this invention is to be utilized. Many types of material dry very quickly, such as for example, acrylic paints or polystyrene-based glue. In order to maintain a skin-free or lump-free working material, the user of such materials ordinarily has to unscrew and rescrew a threaded cap on their container as well as having to pick up and lay back down the container, such as a tube of paint, each time its contents are accessed. Using the device of this invention frees the user from the above-mentioned time-consuming steps of the prior art.

DESCRIPTION OF THE PREFERRED EMBODIMENT(S)

Figure 1:
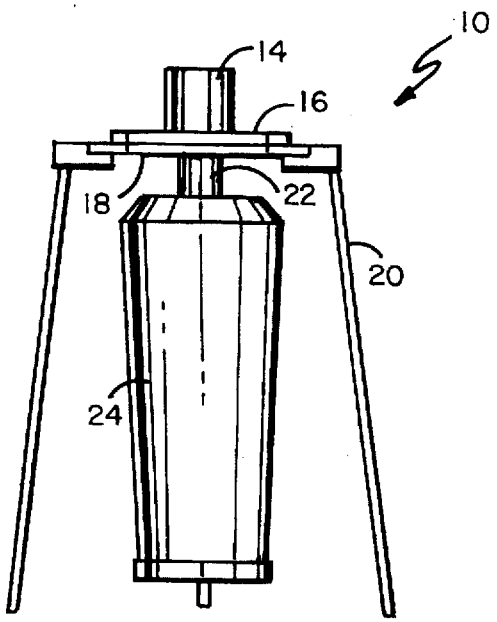
FIG. 1 illustrates a side view of one embodiment of the palette dispenser of this invention wherein a tube of material is disposed under a tripod supporting structure and shows the palette base and cover member disposed thereon.
Figure 4:
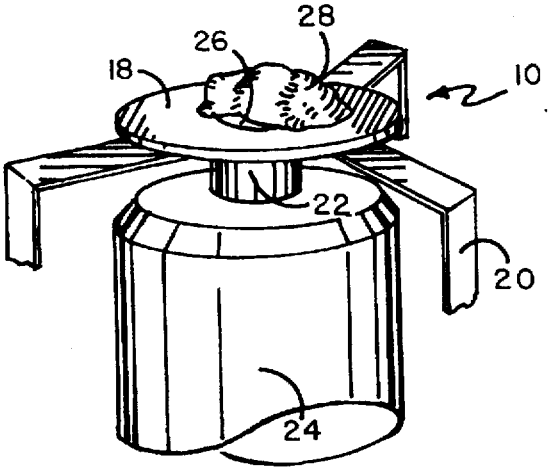
FIG. 4 illustrates a view of the device shown in FIG. 3 with some of the material from the container dispensed on the palette base.
Figure 5:
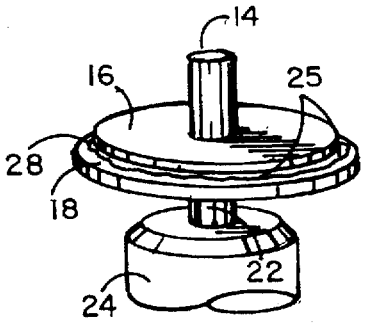
FIG. 5 illustrates a partial view of FIG. 4 showing a cover member in position on top of such material on the palette base.

FIG. 1 illustrates a side view of one embodiment of palette dispenser 10 of this invention wherein a container 24, such as a tube or cartridge, containing paste-like or viscous material is attached at its opening or nozzle 22 to palette base 18 of this invention. The device is supported on three legs 20 in tripod fashion such that palette base 18 is disposed in a horizontal plane. Other equivalent leg supports, such as four legs, can be utilized. As seen in FIG. 4, material 28 can be dispensed out of container opening 26 which material will spread out onto palette base 18. In the non-use mode of the device, cover member 16 is positioned, as seen in FIG. 5, over material 28, causing the edge of material 28 to form a bead 25 beyond the edge of cover member 16. Cover member 16 can have handle member 14 for easy grasping.

Figure 2:
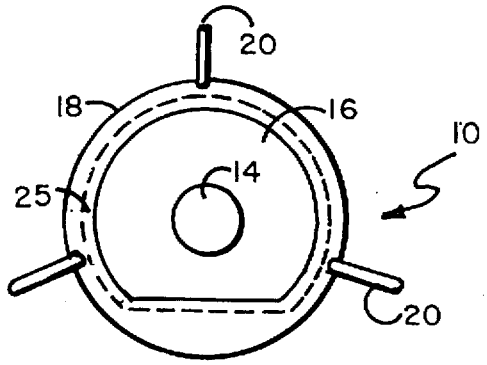
FIG. 2 illustrates a top view of the device of FIG. 1.

FIG. 2 illustrates a top view of device 10 of FIG. 1 in its non-use mode, showing cover member 16 with handle member 14 placed atop palette base 18 where the downward pressure of the cover member being placed on the material on palette base 18 flattens such material forcing it towards the outer edges of the cover member and causes a bead 25 of exposed material to form around the outer edges of the cover member.

Figure 3:
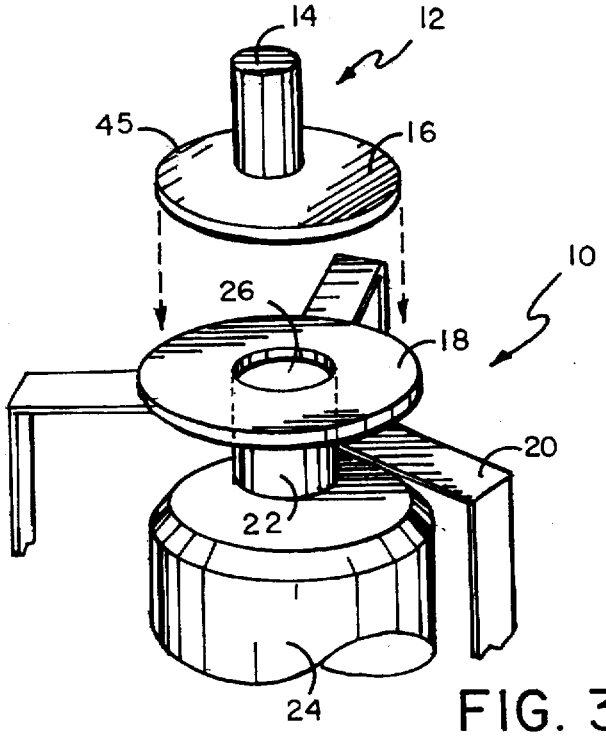
FIG. 3 illustrates a perspective view of the upper portion the device of FIG. 1 with the cover member removed from the palette base.

FIG. 3 illustrates a perspective view of a section of the upper portion of the embodiment of FIG. 1 prior to its use. As shown in FIG. 4, material is squeezed from container tube 24, through nozzle 22, up through opening 26 onto palette base 18. When one desires to use material 28, one can take a portion thereof off palette base 18. In some embodiments one could even use cover member 16 as a dauber to apply such material. As seen in FIGS. 3 and 5, the bottom surface area of cover member 16 that comes in direct contact with the palette base is somewhat smaller in surface area than the surface area of palette base 18, allowing a bead 25 of material to form and dry around the outer edge of cover member 16 when cover member 16 is pushed downward on material 28, forcing it outwards toward the outer edge of cover member 16. A handle member 14 can be disposed on the top of cover member 16 so that it can be easily grasped.

Figure 6:
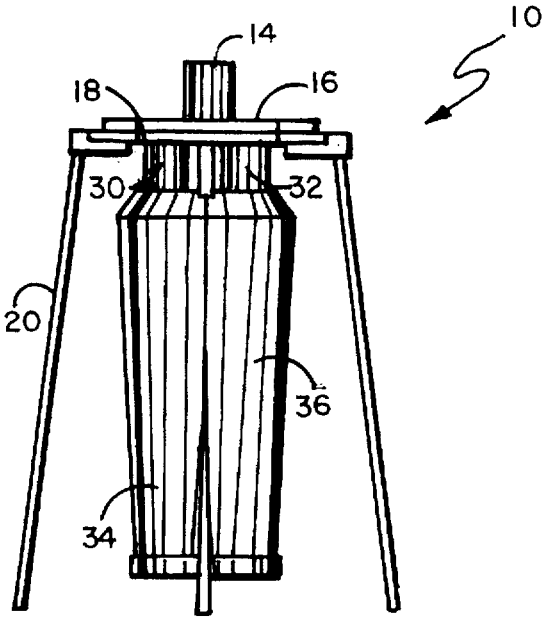
FIG. 6 illustrates a side view of another embodiment of the device wherein two container tubes are disposed under a tripod supporting structure and shows a single cover member disposed on the palette base.
Figure 7:
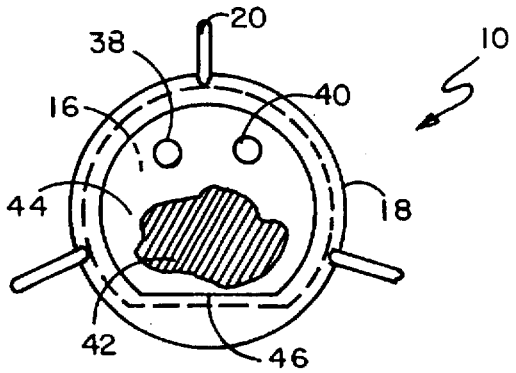
FIG. 7 illustrates a top view of the embodiment of FIG. 6 showing material from each of the two container tubes mixed together on the palette base.

FIG. 5 illustrates a perspective partial view of the embodiment of FIG. 1 showing cover member 16 in position on palette base 18 and material 28 oozing out from between cover member 16 and palette base 18 to form a bead 25. Material 28 within container 24 can be paint, glue and the like where palette base 18 can be used for mixing such material. In one embodiment, as seen in FIG. 6, first and second tubes 34 and 36 each contain material which enters, respectively, through first and second nozzles 30 and 32 through first and second openings 38 and 40, as seen in top view in FIG. 7, onto palette base 18. Squeezing first and second tubes 34 and 36 causes their respective material to emerge onto palette base 18 where they can be mixed in a mixing area 42 for the purpose, for example if first and second containers 34 and 36 contain paint, of obtaining various shades of paint. When one wishes to cease temporarily working with the materials in first and second tubes 34 and 36, one can then store the mixed material in mixing area 42 by placing cover member 16 thereover and exerting slight downward pressure to cause the material under the cover member to flatten and produce a bead of material around the outer edge of the cover member. At a later time when one desires to work with the mixed materials or to utilize the materials in the tube(s), the now-dried edge bead can be scraped off after the cover member is removed from the palette base. In one embodiment of this invention, cover member 16 can have a straight edge 45, as seen in FIG. 3, which can be used as a scraper to scrape off unwanted material on palette base 18. Palette base 18 can have an indented area 46 therein, as seen in FIG. 7, to match the shape of cover member 16 which, if it has a straight edge such as straight edge 45 thereon, the cover member cannot rotate within the indented area. If first and second tubes 34 and 36 contain multipart glues, such glues can be mixed together in mixing area 42 on palette base 18.

The device of this invention can be made of metal or plastic. In some embodiments the cover member and palette base can be made of materials that are magnetically attracted to one another so as to pull the cover member against the palette base and hold it in place by such magnetic attraction. This action of pulling the cap toward the palette base will help seal the opening under the cover member and aid in making an air-tight seal. In further embodiments, the cover member can be made of a stretchable material, such as rubber, which when pulled on and thereby stretched, will help release its attachment to the material on the palette base. This stretchable cover member is especially helpful for use when the material within the container is a glue or paint.

Figure 8:
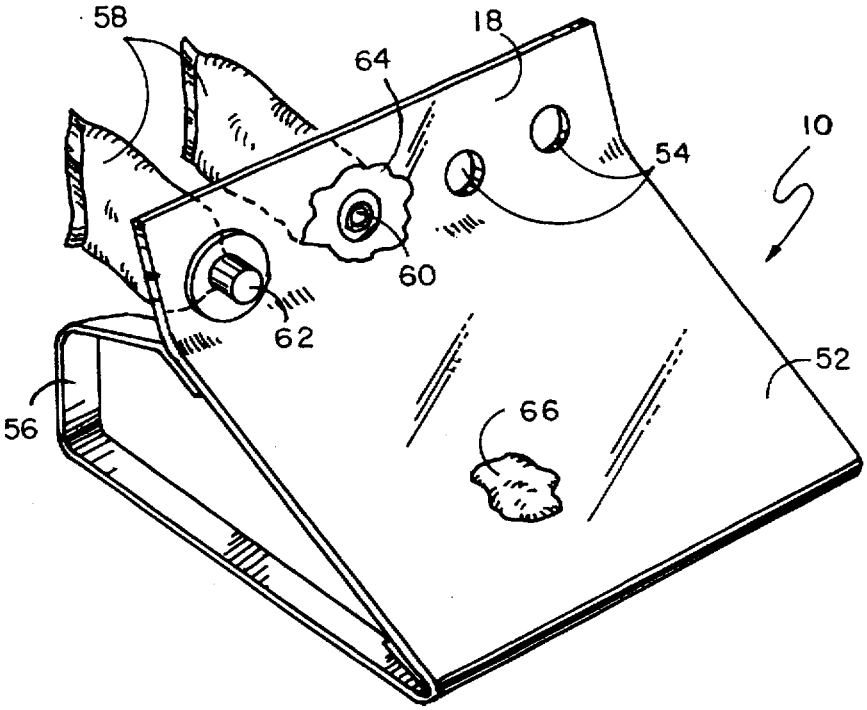
FIG. 8 illustrates a perspective view of a further embodiment of the device having an enlarged mixing area on the palette base with means for receiving and supporting a plurality of containers.

FIG. 8 illustrates an alternate embodiment 50 of the device of this invention for the receipt and support of a plurality of containers in the form of paint tubes 58 fitted with threaded nozzles and caps thereon. These tubes, after their caps have been removed, can then have their threaded nozzles rotated into threaded apertures 54 on the device until the tubes' openings 60 are substantially flush or close to the surface of the palette base. A cover member 62 can be positioned over each opening as desired, spreading out the paint thereunder. The palette base 18 below the apertures can be disposed at a downward angle to the horizontal and can extend forward forming a large mixing area 52 on the surface of the palette base. The device can be supported by support members on each side, such as support member 56 or by equivalent support means. A plurality of threaded apertures 54 can be disposed in the device for receipt of an equivalent number of paint tubes or other material containers having threaded nozzles. The materials 64 from tubes 58 can be mixed with one another on mixing area 52 to form, for example, mixed color material 66. Alternate embodiment 50 can form, in one embodiment, an artist's palette with mixing area 52 for mixing many different shades of paint color. Alternate embodiment 50 can hold a plurality of tubes in a neat array. Having this embodiment supported by support members and having the mixing area extend at a downward angle to the horizontal makes it easier for artists to mix paint colors thereon and then later to apply individual cover members over each paint tube opening 60 and the paint therearound, with the paint forming a bead around the outer edge of each cover member drying while maintaining the freshness of the paint under the cover member. Thus, the device of this invention in its many embodiments will provide more economical usage of the material within its container(s).

Although the present invention has been described with reference to particular embodiments, it will be apparent to those skilled in the art that variations and modifications can be substituted therefor without departing from the principles and spirit of the invention.

I claim:

1. In combination, a material contained in a container having a nozzle, a dispenser having a palette base having a surface area with an aperture defined therein to receive said nozzle of said container, said dispenser for dispensing said material through said aperture onto said palette base with a mixing area defined on said palette base for disposing said material;

means for supporting said palette base; and a cover member having a substantially planar bottom surface and an outer edge, said bottom surface having a surface area, said cover member for positioning over said aperture in said palette base whereby by forcing said cover member onto said palette member above said aperture, some of said material is forced from between said palette member and said cover member to said outer edge of said cover member forming an outer edge of said material which outer edge of material will dry, sealing and protecting the remaining material under said cover member from contact with the air and preventing it from drying out.

2. The device of claim 1 wherein said bottom surface area of said cover member is smaller than said surface area of said palette base.

3. The device of claim 2 further including:

a plurality of apertures defined in said palette base, each for receipt of a nozzle of a container containing material; and a plurality of cover members corresponding in number to said number of apertures, said dispenser for dispensing of more than one material onto said palette base.

4. The device of claim 2 wherein said means for supporting said palette base are at least two legs attached to said palette base.

5. The device of claim 2 wherein said cover member has a straight edge portion thereof to act as a scraper to remove said material on said palette base.

6. The device of claim 2 further including an enlarged mixing area on said palette base.

7. The device of claim 3 further including an enlarged mixing area on said palette base.

8. The device of claim 6 wherein said mixing area of said palette base is disposed at a downward angle to the horizontal for ease of mixing material thereon.

9. The device of claim 7 wherein said mixing area of said palette base is disposed at a downward angle to the horizontal for ease of mixing material thereon.

10. The device of claim 2 wherein said cover member is magnetically attracted to said palette base.

11. The device of claim 3 wherein said cover members are magnetically attracted to said palette base.

* * * * *